US011017933B2

(12) United States Patent
Tamura

(10) Patent No.: US 11,017,933 B2
(45) Date of Patent: May 25, 2021

(54) WINDING COIL COMPONENT

(71) Applicant: Murata Manufacturing Co., Ltd., Kyoto-fu (JP)

(72) Inventor: Yuka Tamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 159 days.

(21) Appl. No.: 16/038,026

(22) Filed: Jul. 17, 2018

(65) Prior Publication Data

US 2019/0043650 A1 Feb. 7, 2019

(30) Foreign Application Priority Data

Aug. 2, 2017 (JP) ..... JP2017-149600

(51) Int. Cl.

| | |
|---|---|
| ***H01F 17/04*** | (2006.01) |
| ***H01F 27/32*** | (2006.01) |
| ***H01F 27/29*** | (2006.01) |
| ***H01F 27/28*** | (2006.01) |
| *H01F 1/24* | (2006.01) |
| *H01F 41/04* | (2006.01) |
| *H01F 41/071* | (2016.01) |

(52) U.S. Cl.

CPC ..... *H01F 17/045* (2013.01); *H01F 27/2823* (2013.01); *H01F 27/292* (2013.01); *H01F 27/32* (2013.01); *H01F 1/24* (2013.01); *H01F 41/04* (2013.01); *H01F 41/071* (2016.01)

(58) Field of Classification Search

CPC ..... H01F 27/2823
USPC ..... 336/221
See application file for complete search history.

(56) References Cited

U.S. PATENT DOCUMENTS

2011/0203105 A1 8/2011 Ishido et al.
2016/0118184 A1* 4/2016 Ukai ..... H01F 27/29 336/192

FOREIGN PATENT DOCUMENTS

| | | | |
|---|---|---|---|
| CN | 102227788 | A | 10/2011 |
| CN | 105551713 | A | 5/2016 |
| JP | 2011-082463 | A | 4/2011 |
| JP | 2016-086034 | A | 5/2016 |
| WO | 2010067515 | A1 | 6/2010 |

OTHER PUBLICATIONS

An Office Action mailed by the China National Intellectual Property Administration dated Jul. 20, 2020, which corresponds to Chinese Patent Application No. 201810749748.X and is related to U.S. Appl. No. 16/038,026 with English language translation.

* cited by examiner

*Primary Examiner* — Ronald Hinson
(74) *Attorney, Agent, or Firm* — Studebaker & Brackett PC

(57) ABSTRACT

A winding coil component includes a drum-shaped core including a winding core having a substantially n-sided prism shape having n side surfaces positioned around a central axis. The n side surfaces include a first side surface facing a mounting substrate and wire wound around the winding core portion and forming a multilayer portion in layers including a superposition beginning portion located in a region other than a region above an n-th side surface to which the n side surfaces are arranged in order from the first side surface in a winding direction in which a lowest layer of the multilayer portion winds toward the superposition beginning portion.

13 Claims, 7 Drawing Sheets

WINDING COIL COMPONENT

CROSS-REFERENCE TO RELATED APPLICATION

This application claims benefit of priority to Japanese Patent Application No. 2017-149600, filed Aug. 2, 2017, the entire content of which is incorporated herein by reference.

BACKGROUND

Technical Field

The present disclosure relates to a winding coil component, and more particularly, to a winding coil component that includes a drum-shaped core including a winding core portion, and a wire wound around the winding core portion of the drum-shaped core in layers.

Background Art

For example, Japanese Unexamined Patent Application Publication No. 2011-82463 discloses a winding coil component including a wire that is wound around a winding core portion of a drum-shaped core and that is stacked thereon in three or more layers. A technique disclosed in Japanese Unexamined Patent Application Publication No. 2011-82463 aims to obtain a high impedance at a desired frequency in a manner in which a resonant frequency is shifted to a low frequency side. To achieve this aim, the wire is wound such that the number of turns in a second layer is at least two turns smaller than the number of turns in a first layer. The number of turns in the second layer greatly affects a self-resonant frequency. An appropriate number of turns in the second layer, which is at least two turns smaller than that in the first layer, enables the self-resonant frequency to be in a desired frequency band.

SUMMARY

As disclosed in Japanese Unexamined Patent Application Publication No. 2011-82463, the winding coil component including the wire that is wound around the winding core portion and that is stacked thereon in layers needs a superposition beginning portion at which the wire shifts from a lower layer side to an upper layer side. The winding coil component cannot avoid the occurrence of a stray capacitance between lines of the wound wire.

The present inventor has conceived that when the wire is wound around the winding core portion, the stray capacitance of the entire winding coil component changes depending on the position of the superposition beginning portion in the circumferential direction of the winding core portion. It is considered that the change in the stray capacitance affects the Q factor and the resonant frequency of the winding coil component.

Japanese Unexamined Patent Application Publication No. 2011-82463, however, does not disclose the position of the superposition beginning portion at all.

The present disclosure provides a winding coil component including the superposition beginning portion that enables the Q factor to be improved.

According to one embodiment of the present disclosure, a winding coil component includes a drum-shaped core including a winding core portion, a first flange portion and a second flange portion. The first flange portion and the second flange portion are positioned on respective end portions of the winding core portion that are opposite each other along a central axis of the winding core portion. The winding core portion has a substantially n-sided prism (n is a natural number of 3 or more) shape having n side surfaces positioned around the central axis. The n side surfaces include a first side surface facing a mounting substrate. A wire is wound around the winding core portion and forms at least one multilayer portion wound around the winding core portion in layers such that the multilayer portion includes a superposition beginning portion at which the wire shifts from a lower layer side to an upper layer side.

The n side surfaces are arranged in order from the first side surface to a n-th side surface in a winding direction in which a lowest layer of the multilayer portion winds toward the superposition beginning portion. The superposition beginning portion includes a first superposition beginning portion located in a region other than a region above the n-th side surface.

The first superposition beginning portion can be located in a region above one of the n side surfaces other than the n-th side surface. The first superposition beginning portion can be located above a ridge line between adjacent side surfaces of the n side surfaces. With the above structures, the wound wire can be stable.

The winding core portion preferably has a substantially quadrangular prism shape having the first side surface, a second side surface, a third side surface and a fourth side surface in order in the winding direction. This enables the winding core portion to be readily formed.

When the winding core portion has a substantially quadrangular prism shape, the first superposition beginning portion is preferably located in a region above the third side surface in order to improve the Q factor.

When the winding core portion has a substantially quadrangular prism shape, the first superposition beginning portion may be located in a region above the first side surface. With this structure, the number of turns (at the level of a fraction) on the upper layer side can be larger than the number of turns on the lower layer side, and the number of turns can be increased with respect to the length of the winding core portion.

It is preferable that the superposition beginning portion only consists of a plurality of the first superposition beginning portions. With this structure, the Q factor can be further improved.

The wire may include a plurality of the multilayer portions, and the plurality of the multilayer portions are arranged along the central axis.

According to another embodiment of the present disclosure, a winding coil component includes a drum-shaped core including a winding core portion, a first flange portion and a second flange portion. The first flange portion and the second flange portion are positioned on respective end portions of the winding core portion that are opposite each other along a central axis of the winding core portion. A wire is wound around the winding core portion and forms a multilayer portion wound around the winding core portion in layers such that the multilayer portion includes a superposition beginning portion at which the wire shifts from a lower layer side to an upper layer side. A first terminal electrode is mounted on a surface of the first flange portion that faces a mounting substrate side and is connected to a first end of the wire, and a second terminal electrode is mounted on a surface of the second flange portion that faces the mounting substrate side and is connected to a second end of the wire.

The wire is wound from the first end to the second end in a winding direction in which a lowest layer of the multilayer portion winds toward the superposition beginning portion. The superposition beginning portion includes a first superposition beginning portion located in a region other than a region within a range from 225° to 315° in terms of an angle measured about the central axis from the first end in the winding direction. The winding core portion may have a substantially n-sided prism shape having planer circumferential surfaces, or a shape having no planer circumferential surfaces such as a substantially column shape or a substantially elliptic cylinder shape.

The first superposition beginning portion is preferably located within a range from 0° to 225°, more preferably from 90° to 225°, further preferably from 180° to 225° in terms of the angle measured about the central axis from the first end in the winding direction. When the superposition beginning portion of the wire is located in the latter part of some turn of the wire, the stray capacitance is further decreased, and a reactance is further improved. Consequently, the Q factor can be further improved.

It is preferable that the superposition beginning portion only consists of a plurality of the first superposition beginning portions. With this structure, the Q factor can be further improved.

The wire may include a plurality of the multilayer portions, and the plurality of the multilayer portions may be arranged along the central axis of the winding core portion.

According to the embodiments of the present disclosure, the Q factor of the winding coil component can be improved as seen from data described later. The reason is presumably that the stray capacitance between lines of the wire is decreased, and the reactance is improved.

Other features, elements, characteristics and advantages of the present disclosure will become more apparent from the following detailed description with reference to the attached drawings.

BRIEF DESCRIPTION OF THE DRAWINGS

FIGS. 6A and 6B illustrate comparison among samples ES1, ES2, and ES4, where the superposition beginning portion of the wire is located above a first side surface S1 in FIG. 3 in the sample ES1, is located above a second side surface S2 in the sample ES2, and is located above a fourth side surface S4 in the sample ES4;

FIGS. 7A to 7C illustrate schematic sectional views for illustration of the stray capacitance between lines of the wire, in which FIG. 7A illustrates a state of the wire on a side surface adjacent on a front side to a side surface above which the superposition beginning portion is located, FIG. 7B illustrates a state of the wire on the side surface above which the superposition beginning portion is located, and FIG. 7C illustrates a state of the wire on a side surface adjacent on a rear side to the side surface above which the superposition beginning portion is located;

DETAILED DESCRIPTION

A winding coil component 1 according to a first embodiment of the present disclosure will be described with reference to FIG. 1 to FIG. 6B.

Figure 1:
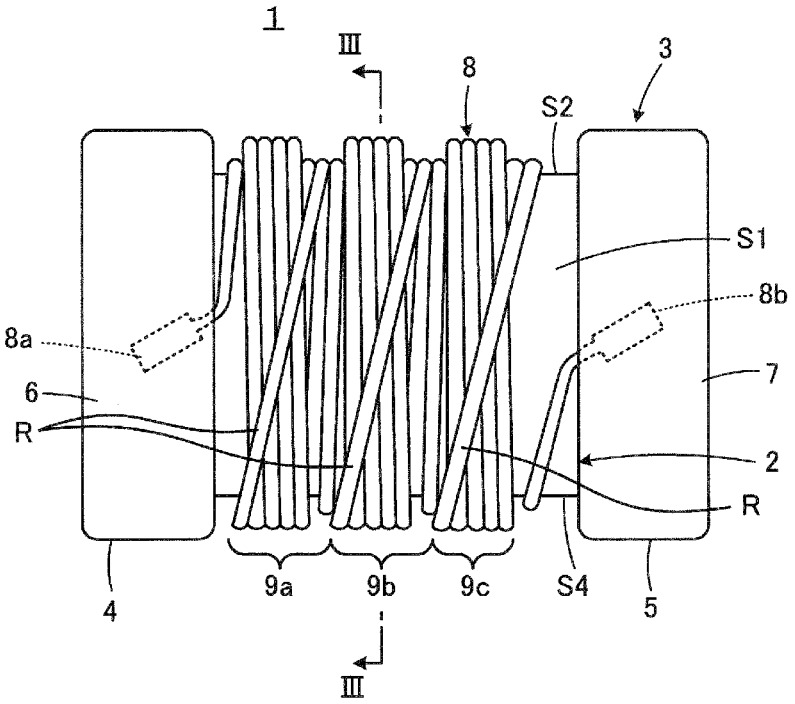
FIG. 1 illustrates a winding coil component according to a first embodiment of the present disclosure viewed from a mounting substrate side.

As well illustrated in FIG. 1, the winding coil component 1 includes a drum-shaped core 3 including a winding core portion 2. The drum-shaped core 3 includes a first flange portion 4 and a second flange portion 5 that are positioned on respective end portions of the winding core portion 2 that are opposite each other along a central axis 10 of the winding core portion 2. The drum-shaped core 3 is composed of an electrical insulation material, more specifically, a non-magnetic material such as alumina, a magnetic material such as ferrite, or a resin. As seen from FIG. 3, the winding core portion 2 and the first and second flange portions 4 and 5 of the drum-shaped core 3 each have a substantially quadrangular prism shape having a substantially quadrilateral sectional shape. As illustrated, portions along ridge lines of the winding core portion 2 and the first and second flange portions 4 and 5 having a substantially quadrangular prism shape are preferably rounded.

The winding coil component 1 includes a wire 8 wound around the winding core portion 2 in a certain winding direction. The wire 8 is formed of a copper wire coated with an insulator such as polyester imide. The wire 8 typically has a substantially circular sectional shape but may be a rectangular wire having a substantially rectangular sectional shape.

Figure 2:
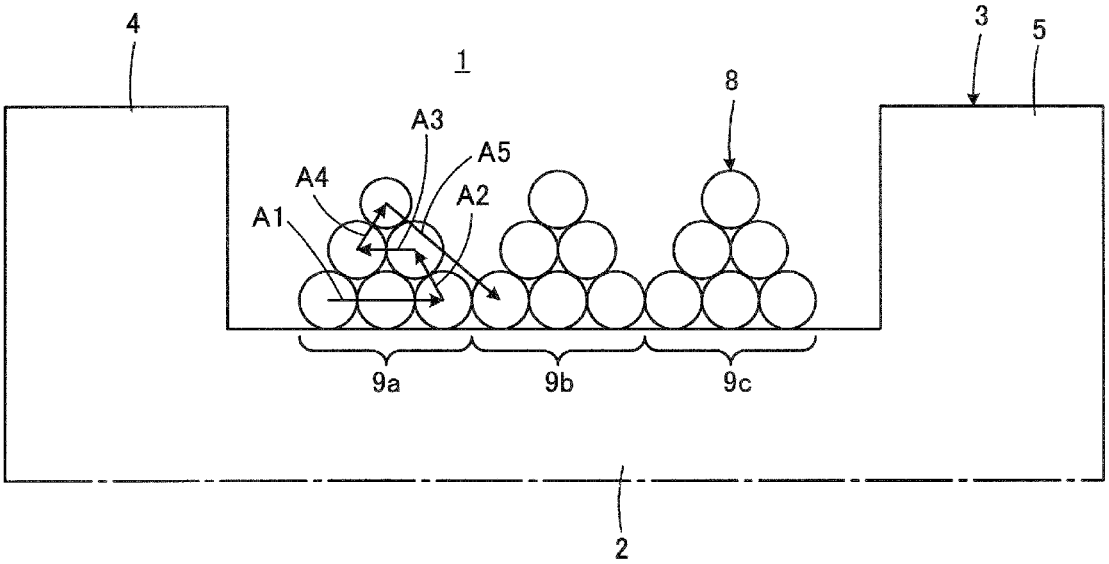
FIG. 2 is a schematic sectional view of the winding coil component and illustrates a state where a wire of the winding coil component illustrated in FIG. 1 is wound.

The wire 8 forms, for example, three multilayer portions 9*a*, 9*b*, and 9*c* that are wound around the winding core portion 2 in layers. FIG. 2 illustrates a state where the wire 8 of the winding coil component 1 is wound. The number of turns of the wire 8 illustrated in FIG. 2 is smaller than the number of turns of the wire 8 illustrated in FIG. 1. It is to be understood that FIG. 2 illustrates the winding coil component 1 in a simplified manner. Each of the multilayer portions 9*a*, 9*b*, and 9*c* includes superposition beginning portions R at which the wire 8 shifts from the lower layer side to the upper layer side.

As illustrated in FIG. 1, a first terminal electrode 6 is mounted on a surface of the first flange portion 4 that faces a mounting substrate (not illustrated) side and connected to a first end 8*a* of the wire 8. A second terminal electrode 7 is mounted on a surface of the second flange portion 5 that faces the mounting substrate side and connected to a second end 8*b* of the wire 8. The first and second terminal electrodes 6 and 7 are typically formed by, for example, baking of a conductive paste whose conductive component is silver. Ni plating, Cu plating, and Sn plating may be performed thereon in this order, as needed. Alternatively, the first and second terminal electrodes 6 and 7 may be mounted in a manner in which metal terminals formed of a conductive metal are attached to the respective first and second flange portions 4 and 5.

The wire 8 is wound from the first end 8*a* to the second end 8*b* in a winding direction in which a lowest layer of the multilayer portions 9*a* to 9*c* winds toward the superposition beginning portion R. The first end 8*a* of the wire 8 corresponds to a first end of a first layer that is the lowest layer of the first multilayer portion 9*a*.

Referring to FIG. 2, at the first multilayer portion 9*a*, the wire 8 is first wound around the winding core portion 2 so as to be arranged in the direction from the first flange portion 4 toward the second flange portion 5 as illustrated by an arrow A1 and forms the first layer. The wire 8 subsequently shifts from the first layer to a second layer as illustrated by an arrow A2. The wire 8 is subsequently wound so as to be arranged in the direction from the second flange portion 5 toward the first flange portion 4 as illustrated by an arrow A3 directed in the direction opposite the direction of the arrow A1 and forms the second layer. The wire 8 subsequently shifts from the second layer to a third layer as illustrated by an arrow A4. The wire 8 is subsequently wound in the third layer with the number of turns being one turn or less, and is guided to a position at which the wire 8 comes into contact with the winding core portion 2 as illustrated by an arrow A5. At this point, a first end of the second multilayer portion 9*b* is defined.

The wire 8 is subsequently wound at the second multilayer portion 9*b* and the third multilayer portion 9*c* in the same manner as in the case of the first multilayer portion 9*a*. Subsequently, the second end 8*b* of the wire 8 that corresponds to a second end of the third multilayer portion 9*c* of the wire 8 is connected to the second terminal electrode 7 (see FIG. 1). The wire 8 is connected to the first and second terminal electrodes 6 and 7 by, for example, thermo-compression bonding.

According to the present disclosure, an important factor is above which of the circumferential surfaces of the winding core portion 2 the superposition beginning portion R is located.

Figure 3:
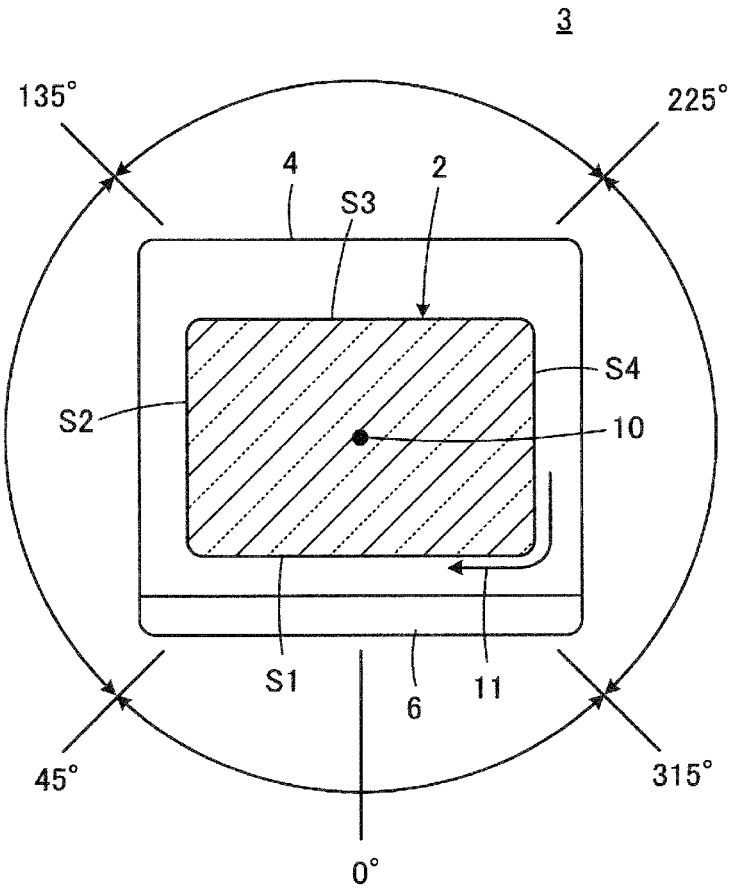
FIG. 3 is a sectional view of a drum-shaped core of the winding coil component illustrated in FIG. 1 taken along line III-III.

Referring to FIG. 3, the winding core portion 2 has a substantially quadrangular prism shape as described above. The substantially quadrangular prism shape has four side surfaces positioned around the central axis 10, and the four side surfaces include a first side surface S1 facing the mounting substrate side, that is, a side surface located on a side on which the first and second terminal electrodes 6 and 7 are mounted on the first and second flange portions 4 and 5. The four side surfaces arranged in order from the first side surface S1 to a fourth surface S4, that is, in the order of the first side surface S1, a second side surface S2, a third side surface S3, and the fourth side surface S4 in the winding direction 11 in which the lowest layer of the multilayer portions 9*a* to 9*c* winds toward the superposition beginning portion.

Figure 4:
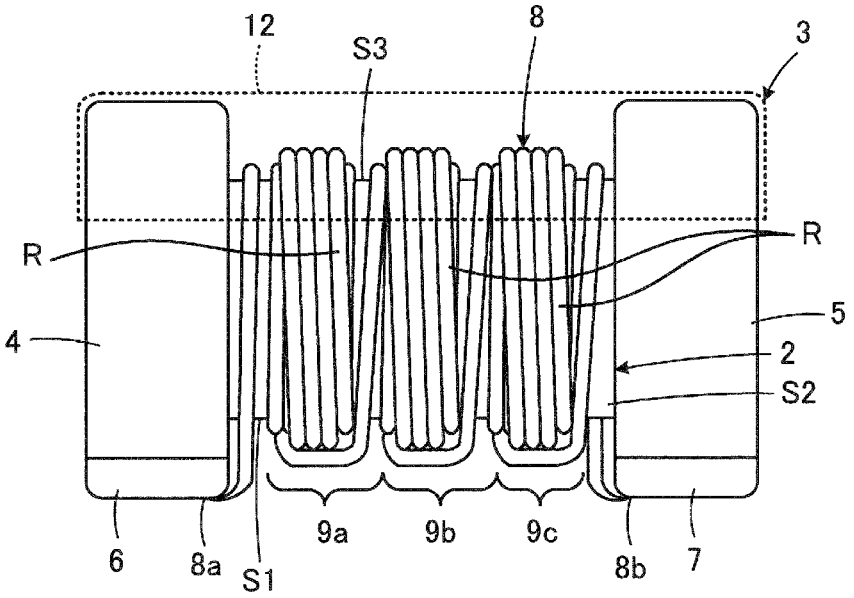
FIG. 4 illustrates the winding coil component illustrated in FIG. 1 viewed from a direction of a second side surface S2 illustrated in FIG. 3.
Figure 5:
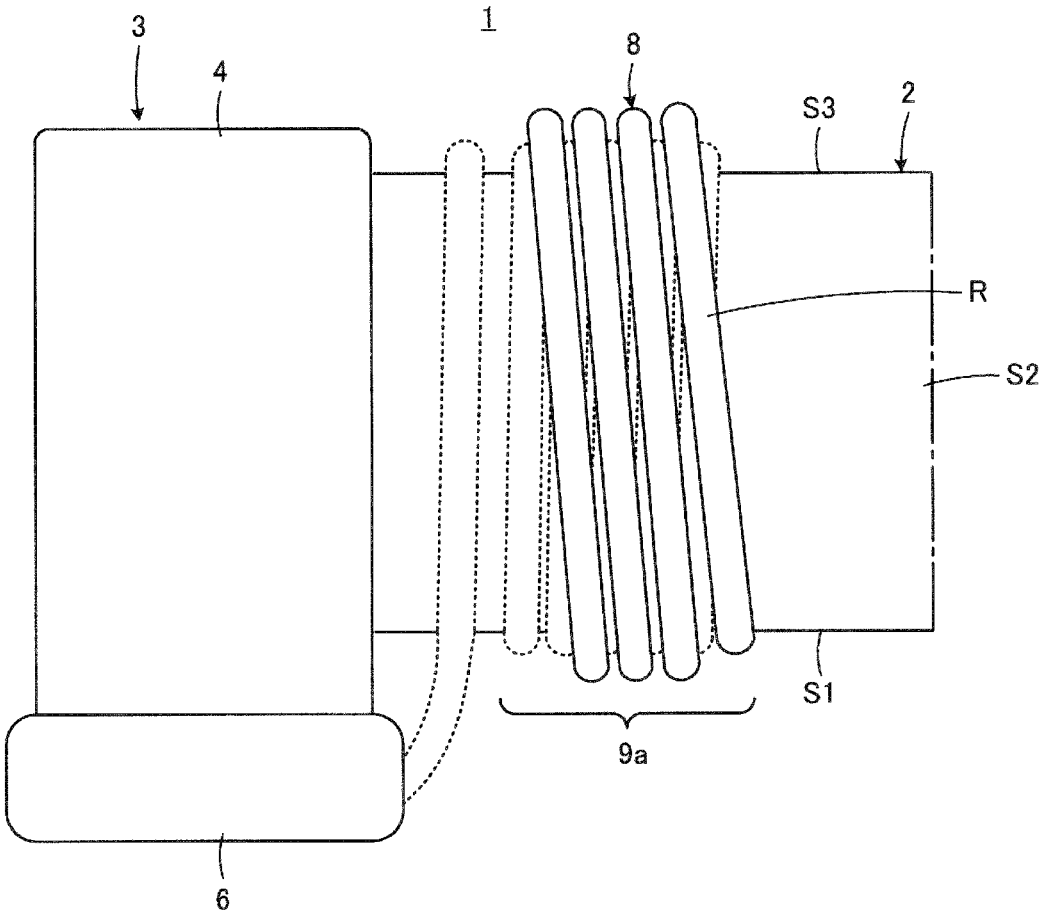
FIG. 5 is an enlarged view of a part of FIG. 4 and illustrates one of superposition beginning portions of the wire.

FIG. 4 illustrates the winding coil component 1 viewed from the direction of the second side surface S2. In FIG. 4, a coating member 12 illustrated by a dashed line is mounted so as to connect a pair of the first and second flange portions 4 and 5 to each other on a side opposite the side on which the first and second terminal electrodes 6 and 7 are mounted on the first and second flange portions 4 and 5. The coating member 12 is mounted as needed. A plate member prepared in advance may be mounted so as to connect the pair of the first and second flange portions 4 and 5 to each other instead of the coating member 12. FIG. 5 is an enlarged view of a part of FIG. 4 and illustrates one of the superposition beginning portions R of the wire 8.

Referring to FIG. 4 and FIG. 5, when attention is paid to the first multilayer portion 9*a*, it is seen that the superposition beginning portion R that shifts from the first layer side to the second layer side of the wire 8 is located in a region above the second side surface S2. In FIG. 5, the first layer is illustrated by a dashed line, and the second layer is illustrated by a solid line so that the first layer and the second layer of the wire 8 are clearly distinguished.

Also at the second multilayer portion 9*b* and the third multilayer portion 9*c*, as seen from FIG. 4, the superposition beginning portion R that shifts from the first layer side to the second layer side of the wire 8 is located in the region above the second side surface S2.

As illustrated in FIG. 1, at the first to third multilayer portions 9*a* to 9*c*, the superposition beginning portion R that shifts from the second layer side to the third layer side of the wire 8 is located in a region above the first side surface S1. In any case, it is important for the superposition beginning portion R of the wire 8 to be located in a region other than a region above the fourth side surface S4.

Figure 6A:
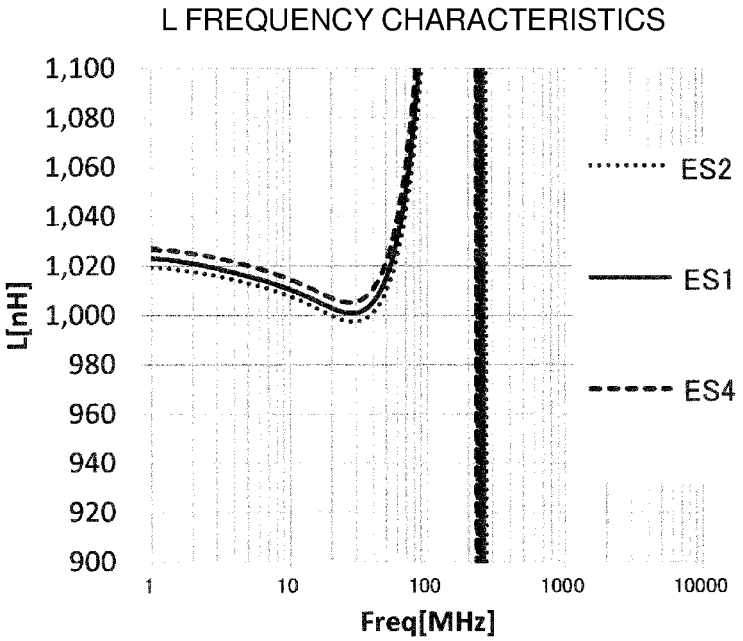
FIG. 6A illustrates frequency characteristics of the inductance of the winding coil component.
Figure 6B:
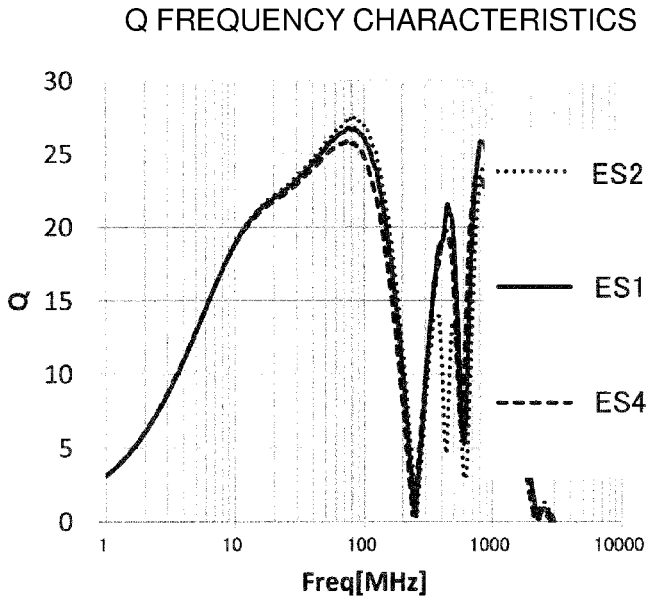
FIG. 6B illustrates frequency characteristics of the Q factor of the winding coil component.

FIGS. 6A and 6B illustrate comparison among samples ES1, ES2, and ES4, and the superposition beginning portion R of the wire 8 of the winding coil component 1 is located above the first side surface S1 in the sample ES1, is located above the second side surface S2 in the sample ES2, and is located above the fourth side surface S4 in the sample ES4. FIG. 6A illustrates frequency characteristics of the inductance of the winding coil component 1. FIG. 6B illustrates frequency characteristics of the Q factor of the winding coil component 1.

The drum-shaped core 3 of the winding coil component 1 prepared to obtain data illustrated in FIGS. 6A and 6B is formed of alumina with a planer dimension of about 2.0 mm×1.5 mm. To form each of the first and second terminal electrodes 6 and 7, a silver paste is applied and baked at a peak temperature of about 700° C., and subsequently, a Ni film having a thickness of about 3 μm, a Cu film having a thickness of about 5 μm, and a Sn film having a thickness of about 16 μm are formed in this order by electroplating. The wire 8 is formed of a polyester imide enameled copper wire having a diameter of about 40 μm. The wire 8 is connected to the first and second terminal electrodes 6 and 7 by thermo-compression bonding at about 510° C. The coating member 12 is formed of a UV curable resin. The coating member 12 is formed by curing with UV light.

Regarding the winding coil component 1 thus specified, the wire 8 is wound in a manner illustrated in FIG. 1 and FIG. 4 to manufacture the sample ES1 in which the superposition beginning portion R of the wire 8 is located above the first side surface S1, the sample ES2 in which the superposition beginning portion R is located above the second side surface S2, and the sample ES4 in which the superposition beginning portion R is located above the fourth side surface S4. In the samples ES1, ES2, and ES4, the number of turns of the entire wire 8 is the same as each other, and the number of turns behind the superposition beginning portion R is the same as each other.

As illustrated in FIG. 6A, the frequency characteristics of the inductance in the samples ES1, ES2, and ES4 are substantially the same as each other. Regarding the frequency characteristics of the Q factor, as illustrated in FIG. 6B, the Q factor in the sample ES1 in which the superposition beginning portion R is located above the first side surface S1 is higher in substantially the entire frequency band than that in the sample ES4 in which the superposition beginning portion R is located above the fourth side surface S4, and the Q factor in the sample ES2 in which the superposition beginning portion R is located above the second side surface S2 is higher in substantially the entire frequency band than that in the sample ES1.

Observation of FIG. 6A reveals that the inductance in the sample ES2 is lower than those in the sample ES1 and the sample ES4, and the inductance in the ES4 is higher than those in the sample ES1 and the sample ES2. For this reason, the Q factors in the samples ES1 and ES2 are supposed to be lower than that in the sample ES4. However, as illustrated in FIG. 6B, the Q factors in the samples ES1 and ES2 are higher than that in the sample ES4 although the inductances in the samples ES1 and ES2 are lower than that in the sample ES4. It can be assumed from this phenomenon that the Q factors in the samples ES1 and ES2 are improved by a degree more than the degree to which the fact that the inductances in the samples ES1 and ES2 are lower than that in the sample ES4 can be overcome.

It is considered that a decrease in the stray capacitance causes the above improvement in the Q factors in the samples ES1 and ES2. This is examined with reference to FIGS. 7A and 7B.

Figure 7A:
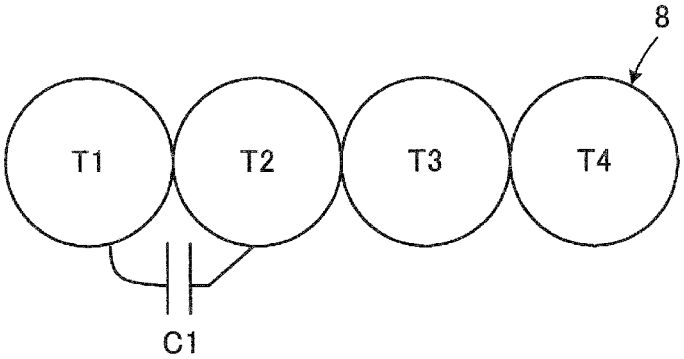
Figure 7B:
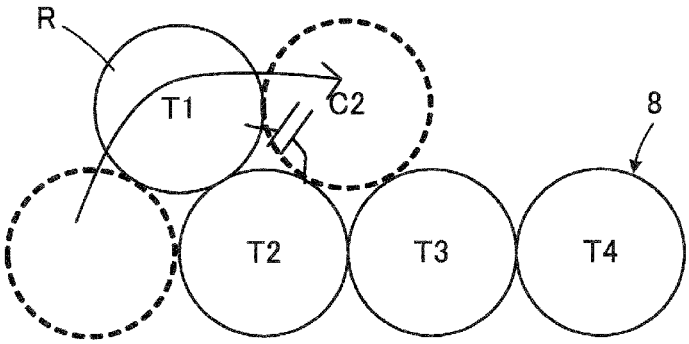
Figure 7C:
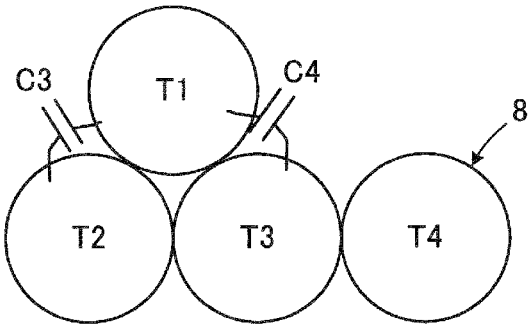

FIG. 7A illustrates a state of the wire 8 on a side surface adjacent on a front side to a side surface above which the superposition beginning portion is located. FIG. 7B illustrates a state of the wire 8 on the side surface above which the superposition beginning portion is located. FIG. 7C illustrates a state of the wire 8 on a side surface adjacent on a rear side to the side surface above which the superposition beginning portion is located. In FIGS. 7A, 7B, and 7C, four turn portions T1, T2, T3, and T4 of the wire 8 are illustrated, and stray capacitances related to the turn portion T1 of the wire 8 are denoted by C1, C2, C3, and C4.

As illustrated in FIG. 7A, at the side surface adjacent on the front side to the side surface above which the superposition beginning portion is located, the stray capacitance C1 exists between the turn portion T1 of the wire 8 that is about to be superposed and the turn portion T2 adjacent thereto.

As illustrated in FIG. 7B, at the side surface above which the superposition beginning portion R is located, the stray capacitance C2 exists between the turn portion T1 that corresponds to the superposition beginning portion R located on the upper layer side and the turn portion T2 located on the lower layer side. The stray capacitance C2 is almost equal to the above stray capacitance C1.

As illustrated in FIG. 7C, at the side surface adjacent on the rear side to the side surface above which the superposition beginning portion is located, the two turn portions T2 and T3 located on the lower layer side are adjacent to the superposed turn portion T1 located on the upper layer side. Accordingly, the stray capacitance C3 exists between the turn portion T1 and the turn portion T2, and the stray capacitance C4 exists between the turn portion T1 and the turn portion T3. That is, at the side surface adjacent on the rear side to the side surface above which the superposition beginning portion is located, the stray capacitance C3+C4 that is higher than the stray capacitance C1 and the stray capacitance C2.

Thus, it can be seen that the stray capacitance C2 at the side surface illustrated in FIG. 7B at which the wire 8 begins to be superposed on the upper layer side is not higher than the stray capacitance C1 at the side surface illustrated in FIG. 7A in front of the superposition. However, at the side surface illustrated in FIG. 7C behind the superposition, the high stray capacitance C3+C4 exists.

Accordingly, when the superposition beginning portion R is located above the fourth side surface S4 as in the sample ES4, the stray capacitance of the first turn portion on the upper layer side is increased from the first side surface S1 at which the wire begins to be wound. That is, the stray capacitance is increased over the entire circumference of the first turn portion.

However, when the superposition beginning portion R is located above the first side surface S1 as in the sample ES1, the stray capacitance of the first turn portion on the upper layer side is increased from the middle, that is, from the second side surface S2, and accordingly, the stray capacitance of the first turn portion on the upper layer side can be decreased.

Similarly, when the superposition beginning portion R is located above the second side surface S1 as in the sample ES2, the stray capacitance of the first turn portion on the upper layer side is increased from the middle. In this case, the stray capacitance is increased from the third side surface S3 behind the second side surface S2, and accordingly, the stray capacitance can be decreased more than in the case of the sample ES1.

It can be easily analogized from the above comparison between the sample ES1 and the sample ES2 that when the superposition beginning portion R is located in a region above the third side surface S3, the stray capacitance can be further decreased, but this is not illustrated. In addition, it can be easily analogized that an effective way to further decrease the stray capacitance is that the superposition beginning portion R is located in the later part of one turn of the wire 8 as much as possible, that is, the superposition beginning portion R is preferably located in a region of 0 turn or more, more preferably ¼ turns or more, further preferably ½ turns or more at one turn of the wire 8 from the reference position at which the first end 8*a* of the wire 8 is connected to the first terminal electrode 6 in the side view, that is, when seen in parallel to the central axis 10 of the winding core portion 2.

It can be also considered that the position of the superposition beginning portion R is the same as in the sample ES4, and the superposition beginning portion R is shifted by the distance corresponding to one turn to the rear side. In this case, however, the number of turns on the lower layer side increases by one turn. This greatly affects a product design. Accordingly, it can be said that an effective way to decrease the stray capacitance without changing the number of turns is that the superposition beginning portion R is located in a region other than the region above the fourth side surface S4 as in the sample ES1 and the sample ES2.

As seen from the above description, a decrease in the stray capacitance at any one location enables the Q factor to be improved. That is, in the above description, the superposition beginning portions R only consists of a plurality of the superposition beginning portions located in the region other than the region above the fourth side surface S4, but the present disclosure is not limited thereto. That is, it is enough for at least one of the superposition beginning portions to locate in the region other than the region above the fourth side surface S4. In the following description, the superposition beginning portion located in the region other than the region above the fourth side surface S4 is called "a first superposition beginning portion R1", which is distinguished from "the superposition beginning portion R".

That is, it is only necessary for the superposition beginning portion R of the wire 8 to include at least one first superposition beginning portion R1. In this case, the stray capacitance can be lower than that in the case where the superposition beginning portions R only consists of the superposition beginning portions located in the region above the fourth side surface S4.

From the perspective of a decrease in the stray capacitance, the stray capacitance can be decreased as the amount of the first superposition beginning portions R1 of the superposition beginning portions R increases. When the superposition beginning portions R only consists of the first superposition beginning portions R1 as in the winding coil component 1, the Q factor can be further improved.

From a different perspective from a decrease in the stray capacitance, the first superposition beginning portion R1 is preferably located in the region above the first side surface S1. Specifically, in this case, the stray capacitance can be decreased, the substantial number of turns on the upper layer side can be increased relative to the number of turns on the lower layer side, and the number of turns can be increased relative to the length of the winding core portion.

In the above description, the winding core portion 2 has a substantially quadrangular prism shape including the four side surfaces S1 to S4. However, the winding core portion 2 may have a substantially prism shape other than the substantially quadrangular prism shape, a substantially column shape, or a substantially elliptic cylinder shape.

When the substantially prism shape is generalized and is represented by a substantially n-sided prism (n is a natural number of 3 or more) shape, a characteristic structure according to the present disclosure can be defined as follows. The superposition beginning portion includes a first superposition beginning portion located in a region other than a region above an n-th side surface, where, the substantially n-sided prism shape has n side surfaces positioned around the central axis, and the n side surfaces include a first side surface facing the mounting substrate and arranged in order from the first side surface to the n-th side surface in the winding direction.

The characteristic structure according to the present disclosure can also be defined by using an angle illustrated in FIG. 3. The superposition beginning portion R includes the first superposition beginning portion R1 located in a region other than a region within a range from 225° to 315° in terms of an angle measured about the central axis 10 from the first end 8*a*(0°) in the winding direction 11. The first superposition beginning portion R1 is preferably located within a range from 0° to 225°, more preferably from 90° to 225°, further preferably from 180° to 225°, in terms of the angle measured about the central axis 10 from the first end 8*a* in the winding direction 11.

The above definition by using the angle means that when the winding core portion 2 has a substantially quadrangular prism shape having a substantially square sectional shape, the superposition beginning portion R1 is located in the region other than the region above the fourth side surface S4. However, the above definition by using the angle is approximately applied also to the case where the winding core portion 2 has not a substantially square sectional shape as in the illustrated embodiment.

The above definition by using the angle is not limited to the case where the winding core portion 2 has a substantially n-sided prism shape having planer circumferential surfaces and can be applied to the case where the winding core portion 2 has a shape having no planer circumferential surfaces such as a substantially column shape or a substantially elliptic cylinder shape.

According to the embodiment described above, as well illustrated in FIG. 5, the superposition beginning portion R of the wire 8 is located in the region above one of the four side surfaces of the substantially quadrangular prism shape of the winding core portion 2 other than the fourth side surface, such as the second side surface S2. In the case where the substantially prism shape of the winding core portion 2 is generalized as the substantially n-sided prism shape, the superposition beginning portion R of the wire 8 is located in the region above one of the n side surfaces of the substantially n-sided prism shape other than the n-th side surface. With this structure, the wound wire can be stable.

However, in the case where the substantially prism shape of the winding core portion 2 is generalized as the substantially n-sided prism shape, the superposition beginning portion R of the wire 8 may be located above a ridge line between adjacent side surfaces of the n side surfaces. A specific example of this structure will be described with reference to FIG. 8.

Figure 8:
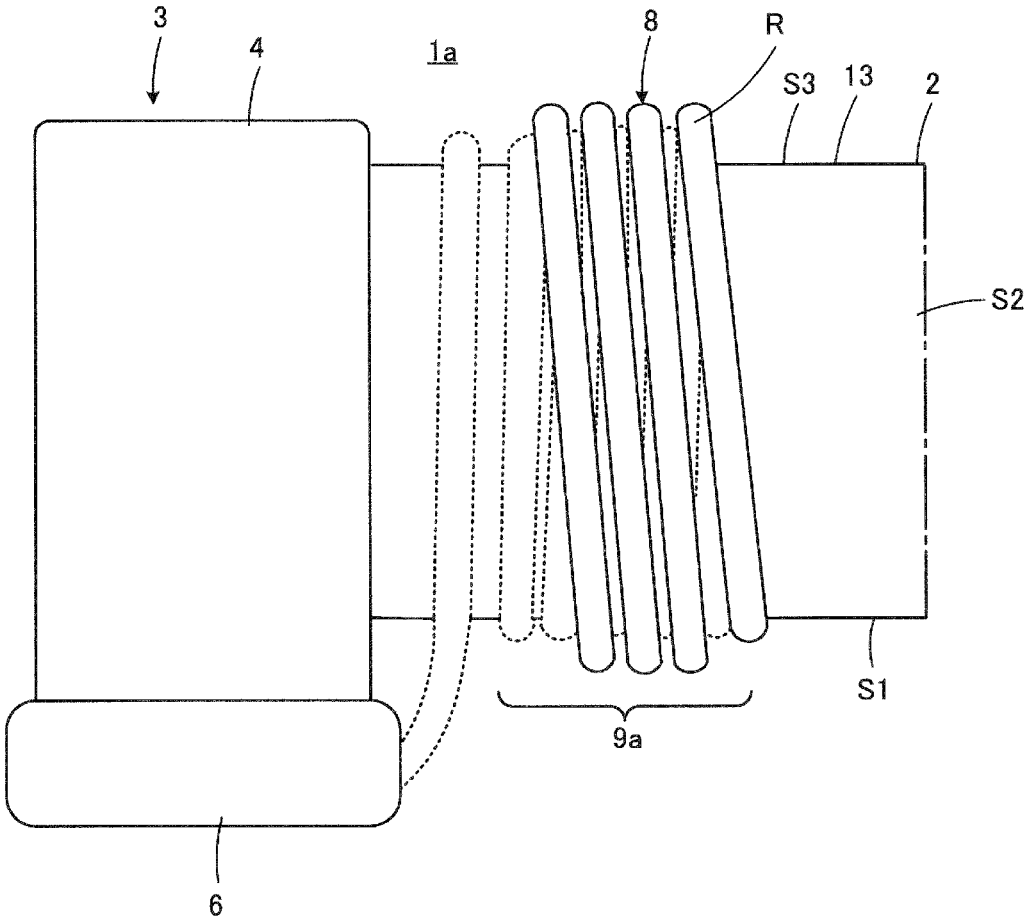
FIG. 8 illustrates a winding coil component according to a second embodiment of the present disclosure and corresponds to FIG. 5.

FIG. 8 corresponds to FIG. 5 and illustrates a winding coil component 1*a* according to a second embodiment of the present disclosure. In FIG. 8, components corresponding to the components illustrated in FIG. 5 are designated by like reference numbers, and a duplicated description is omitted.

As illustrated in FIG. 8, the superposition beginning portion R of the wire 8 is located above a ridge line 13 between the second side surface S2 and the third side surface S3 adjacent to each other. The other structure is the same as in the first embodiment, and a description thereof is omitted.

Figure 9:
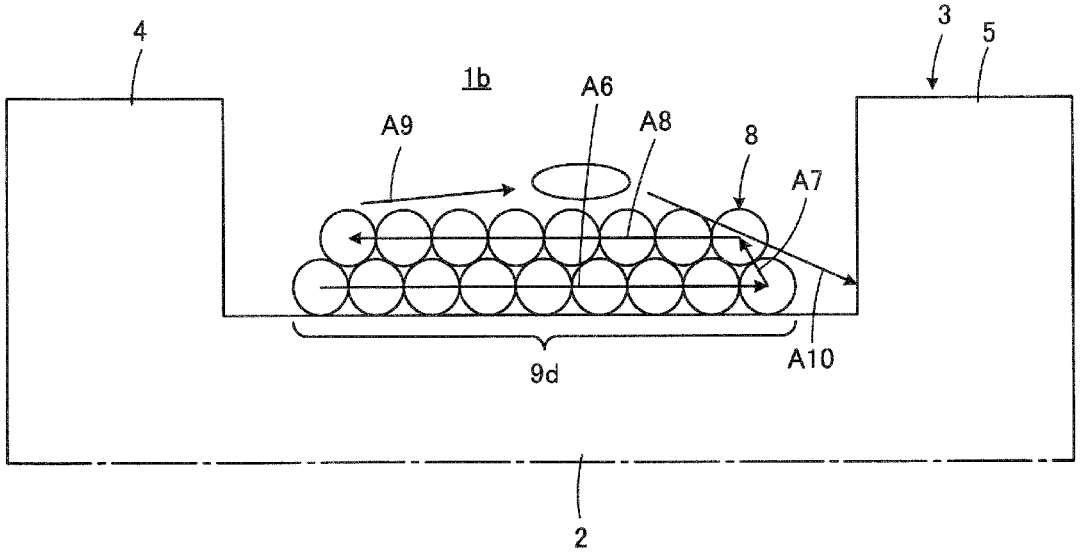
FIG. 9 schematically illustrates a winding coil component according to a third embodiment of the present disclosure and corresponds to FIG. 2.

FIG. 9 corresponds to FIG. 2 and schematically illustrates a winding coil component 1*b* according to a third embodiment of the present disclosure. In FIG. 9, components corresponding to the components illustrated in FIG. 2 are designated by like reference numbers, and a duplicated description is omitted.

According to the embodiment illustrated in FIG. 9, the wire 8 forms a single multilayer portion 9*d*. The first end 8*a* of the wire 8 in the winding direction is connected to the first terminal electrode 6 (see FIG. 1). The first end 8*a* of the wire 8 corresponds to a first end of the first layer that is the lowest layer of the multilayer portion 9*d*.

At the multilayer portion 9*d*, the wire 8 is first wound around the winding core portion 2 in the direction from the first flange portion 4 toward the second flange portion 5 as illustrated by an arrow A6 and forms the first layer. The wire 8 subsequently shifts from the first layer to the second layer as illustrated by an arrow A7. The wire 8 is subsequently wound in the direction from the second flange portion 5 toward the first flange portion 4 as illustrated by an arrow A8 directed in the direction opposite the direction of the arrow A6 and forms the second layer. The wire 8 subsequently shifts from the second layer to the third layer as illustrated by an arrow A9. The wire 8 is subsequently wound in the third layer with the number of turns being one turn or less, and is guided to the second flange portion 5 as illustrated by an arrow A10. At this point, the second end 8*b* of the wire 8 that corresponds to a second end of the multilayer portion 9*d* is connected to the second terminal electrode 7 (see FIG. 1).

Figure 10:
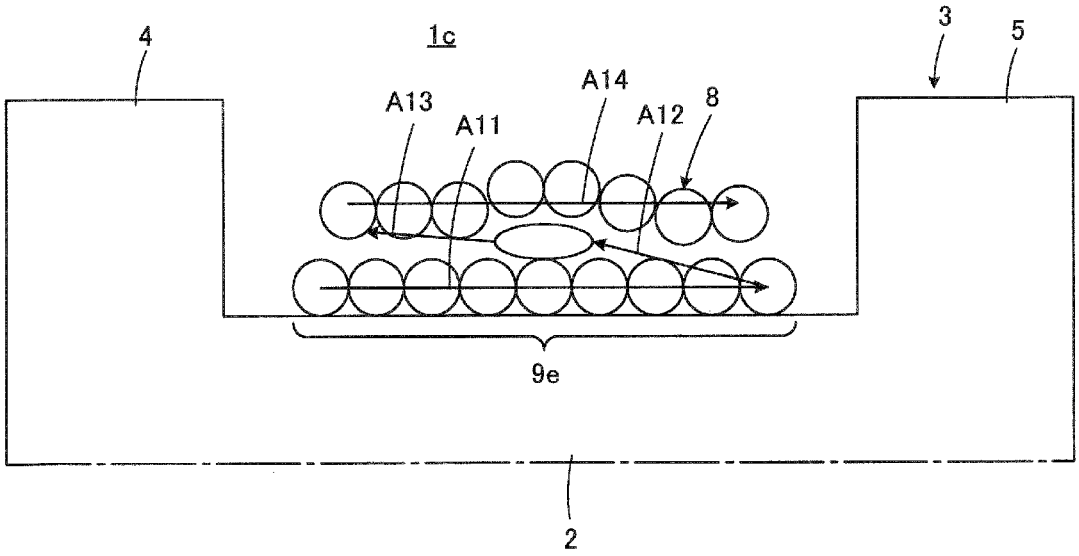
FIG. 10 schematically illustrates a winding coil component according to a fourth embodiment of the present disclosure and corresponds to FIG. 2.

FIG. 10 corresponds to FIG. 2 and schematically illustrates a winding coil component 1*c* according to a fourth embodiment of the present disclosure. In FIG. 10, components corresponding to the components illustrated in FIG. 2 are designated by like reference numbers, and a duplicated description is omitted.

According to the embodiment illustrated in FIG. 10, the wire 8 forms a single multilayer portion 9*e* as in the embodiment illustrated in FIG. 9. The first end 8*a* of the wire 8 in the winding direction is connected to the first terminal electrode 6 (see FIG. 1). The first end 8*a* of the wire 8 corresponds to a first end of the first layer that is the lowest layer of the multilayer portion 9*e*.

At the multilayer portion 9*e*, the wire 8 is first wound around the winding core portion 2 in the direction from the first flange portion 4 toward the second flange portion 5 as illustrated by an arrow A11 and forms the first layer. The wire 8 subsequently shifts from the first layer to the second layer as illustrated by an arrow A12 directed in the direction opposite the direction of the arrow A11. The wire 8 is subsequently wound in the second layer with the number of turns being one turn or less and shifts from the second layer to the third layer as illustrated by an arrow A13 that is directed in the direction opposite the direction of the arrow A11 and in the same direction as the arrow A12. The wire 8 is subsequently wound in the third layer toward the second flange portion 5 as illustrated by an arrow A14 directed in the same direction as the arrow A11. At this point, the second end 8*b* of the wire 8 that corresponds to a second end of the multilayer portion 9*e* is connected to the second terminal electrode 7 (see FIG. 1).

The embodiments are described with reference to the drawings. Various modifications can be made without departing from the scope of the present disclosure.

For example, the number of turns and the number of the layers of the wire 8 at the multilayer portion can be changed appropriately in accordance with the required design.

The number of the multilayer portions arranged along the central axis of the winding core portion may be three or one as illustrated or a number other than three and one.

The position of the superposition beginning portion of the wire 8 at one of the multilayer portions may be different from that at another multilayer portion. In each multilayer portion, the position of the superposition beginning portion in one of the different layers may be different from that in another layer.

The winding coil components according to the embodiments of the present disclosure may include two or more wires. For example, the present disclosure can be used as a coil component of a common mode choke coil.

The above features can be partially replaced and combined between the embodiments.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A winding coil component comprising:

a drum-shaped core including a winding core portion, a first flange portion and a second flange portion, the first flange portion and the second flange portion being positioned on respective end portions of the winding core portion that are opposite each other along a central axis of the winding core portion, the winding core portion including a substantially n-sided prism (n is a natural number of 3 or more) shape having n side surfaces positioned around the central axis, and the n side surfaces including a first side surface facing a mounting substrate; and a wire wound around the winding core portion and forming at least one multilayer portion wound around the winding core portion in layers such that the multilayer portion includes a superposition beginning portion at which the wire shifts from a lower layer side to an upper layer side;

wherein the n side surfaces are arranged in order from the first side surface to a n-th side surface in a winding direction in which a lowest layer of the multilayer portion winds toward the superposition beginning portion, the superposition beginning portion includes a first superposition beginning portion located in a region other than a region above the n-th side surface, the superposition beginning portion is wound in a direction pointing from the second flange to the first flange, the superposition beginning portion is wound from a region above the second side surface to a region above the n−1 side surface, the wire at the upper layer side is wound multiple turns, and the wire at the lower layer side is wound multiple turns.

2. The winding coil component according to claim 1, wherein the first superposition beginning portion is located in a region above one of the n side surfaces other than the n-th side surface.

3. The winding coil component according to claim 1, wherein the first superposition beginning portion is located above a ridge line between adjacent side surfaces of the n side surfaces.

4. The winding coil component according to claim 1, wherein the winding core portion has a substantially quadrangular prism shape having the first side surface, a second side surface, a third side surface and a fourth side surface in order in the winding direction.

5. The winding coil component according to claim 4, wherein the first superposition beginning portion is located in a region above the third side surface.

6. The winding coil component according to claim 1, wherein the superposition beginning portion only consists of a plurality of the first superposition beginning portions.

7. The winding coil component according to claim 1, wherein the at least one multilayer portion includes a plurality of multilayer portions, and the plurality of the multilayer portions are arranged along the central axis.

8. The winding coil component according to claim 1, further comprising:

a first terminal electrode mounted on a surface of the first flange portion that faces a mounting substrate side and connected to a first end of the wire; and a second terminal electrode mounted on a surface of the second flange portion that faces the mounting substrate side and connected to a second end of the wire.

9. A winding coil component comprising:

a drum-shaped core including a winding core portion, a first flange portion and a second flange portion, the first flange portion and the second flange portion being positioned on respective end portions of the winding core portion that are opposite each other along a central axis of the winding core portion;

a wire wound around the winding core portion and forming at least one multilayer portion wound around the winding core portion in layers such that the multilayer portion includes a superposition beginning portion at which the wire shifts from a lower layer side to an upper layer side;

a first terminal electrode mounted on a surface of the first flange portion that faces a mounting substrate side and connected to a first end of the wire; and a second terminal electrode mounted on a surface of the second flange portion that faces the mounting substrate side and connected to a second end of the wire, wherein the wire is wound from the first end to the second end in a winding direction in which a lowest layer of the multilayer portion winds toward the superposition beginning portion, the superposition beginning portion includes a first superposition beginning portion located in a region other than a region within a range from 225° to 315° in terms of an angle measured about the central axis from the first end in the winding direction, the superposition beginning portion is wound in a direction pointing from the second flange to the first flange, the superposition beginning portion is wound above a region extending from 45° to 225° in terms of the angle measured about the central axis from the first end in the winding direction, the wire at the upper layer side is wound multiple turns, and the wire at the lower layer side is wound multiple turns.

10. The winding coil component according to claim 9, wherein the first superposition beginning portion is located within a range from 90° to 225° in terms of the angle measured about the central axis from the first end in the winding direction.

11. The winding coil component according to claim 10, wherein the first superposition beginning portion is located within a range from 180° to 225° in terms of the angle measured about the central axis from the first end in the winding direction.

12. The winding coil component according to claim 9, wherein the superposition beginning portion only consists of a plurality of the first superposition beginning portions.

13. The winding coil component according to claim 9, wherein the at least one multilayer portion includes a plurality of the multilayer portions, and the plurality of the multilayer portions are arranged along the central axis.

* * * * *